United States Patent [19]

Haggerty

[11] 4,164,305

[45] Aug. 14, 1979

[54] SPRAY TYPE DISPENSING CLOSURE

[75] Inventor: Dennis A. Haggerty, Woonsocket, R.I.

[73] Assignee: Polytop Corporation, Slatersville, R.I.

[21] Appl. No.: 818,537

[22] Filed: Jul. 25, 1977

[51] Int. Cl.[2] ..... B05B 7/24

[52] U.S. Cl. ..... 222/4; 222/484; 222/536; 222/635; 239/311; 239/405

[58] Field of Search ..... 222/536, 534, 4, 211, 222/212, 484, 193; 239/327, 405, 311

[56] References Cited

U.S. PATENT DOCUMENTS

| | | | |
|---|---|---|---|
| 2,649,334 | 8/1953 | Schneider | 239/327 |
| 2,673,123 | 3/1954 | Benoit et al. | 239/327 X |
| 3,089,626 | 5/1963 | Kubiliunas | 222/536 X |
| 3,306,499 | 2/1967 | Lykes | 222/536 X |
| 3,477,618 | 11/1969 | Hazard | 222/536 X |

FOREIGN PATENT DOCUMENTS

| | | | |
|---|---|---|---|
| 843481 | 7/1952 | Fed. Rep. of Germany | 239/405 |

*Primary Examiner*—Joseph J. Rolla
*Assistant Examiner*—Frederick R. Handren
*Attorney, Agent, or Firm*—Edward D. O'Brian

[57] ABSTRACT

A closure for use in dispensing a spray of liquid and air can be constructed so as to utilize a cap and a spout rotatably mounted on the cap so as to be capable of being moved between open and closed positions. An air-liquid mixing chamber is located within the spout adjacent to the discharge end of the spout and an orifice is provided on the discharge end of the spout so as to lead from the mixing chamber. A liquid passage and at least one gas passage are provided in the cap and in the spout for conveying liquid and gas into the mixing chamber. A tube extends downwardly from the cap so as to be capable of conveying a liquid to the liquid passage.

5 Claims, 8 Drawing Figures

SPRAY TYPE DISPENSING CLOSURE

BACKGROUND OF THE INVENTION

The invention set forth in this specification pertains to new and improved dispensing closures which are especially constructed so as to be capable of being utilized in dispensing a spray of liquid and air.

In the past many different devices have been developed for utilizing a stream of gas such as air to spray a liquid. An understanding of this invention is not considered to require a detailed consideration of many different prior mechanical spray type devices such as common aspirators and the like. As so called "aerosol" technology has developed such essentially mechanical type devices have not been commonly utilized in many different applications such as, for example, in the cosmetics and toiletries fields. Instead, these industries have extensively utilized so called "aerosol" dispensers for spraying a liquid-gas mixture.

There are several objections to the use of aerosol type dispensers. It is considered that these devices tend to be somewhat unnecessarily expensive because of mechanical and related considerations. Further, aerosol containers are increasingly being found objectionable because normally it is necessary and/or desirable to utilize a propellant within them which consists of one or more halogenated lower aliphatic compounds. It is considered by some that such propellants are somewhat hazardous when utilized within an enclosed space such as a washroom where toiletries or cosmetics are apt to be applied. It is also considered by some that the indiscriminate use of such propellants may be dangerous to the future of mankind because of possible effects on an ozone layer in the outer atmosphere of the earth.

As a result of these attitudes with respect to the use of aerosol dispensers for spraying a liquid there has been a great deal of commercial interest in packaging products which have previously been packed in aerosol type dispensers in containers employed with essentially mechanical or mechanical type spray dispensers. It is considered that those essentially mechanical type spray devices which were extensively utilized prior to the advent or acceptance of aerosol technology are not particularly desirable for use with modern day packaging. It is not considered necessary to encumber this specification with a long discussion as to the basis of this opinion.

Present day packaging as used in certain fields such as the cosmetics and toiletries fields is advanced over prior packaging in which lids were merely placed on and removed from containers because of the use of so called dispensing closures. Such a dispensing closure is constructed so that it can be mounted on a container and normally includes a member such as a spout which can be pivoted between open and closed positions. These dispensing closures are advantageous in that they permit a user to gain access to the contents of a container without having to remove a lid or cap from the container.

Because of the manners in which such dispensing closures have been constructed it has not been considered practical or feasible to incorporate essentially mechanical type spray mechanisms within them. Although there have been efforts in this regard such efforts are considered to have been unsuccessful from a practical standpoint. The principal reasons for this pertain to simplicity of construction and reliability against leakage. In the present day closure field costs are frequently of paramount importance. As a result of this closures which are even slightly expensive than other related closures as a result of molding die complexity and/or as a result of the use of slightly more material than other related closures are relatively unacceptable from a commercial standpoint.

SUMMARY OF THE INVENTION

A broad objective of the present invention is to provide new and improved dispensing closures which are especially constructed so as to be capable of being utilized in dispensing a spray of liquid and air. Because of such utilization these closures may be referred to as spray or spray-type dispensing closures. Other objects of the present invention are to provide closures of the type indicated which are not particularly difficult to manufacture and/or construct, which may be easily installed upon known types of so called "squeeze bottle" type containers, and which are reasonably effective in dispensing a spray of liquid and air when opened and when such a container is compressed.

In accordance with this invention these and other objectives of the invention are achieved by providing a closure for use in dispensing a spray of liquid and air from a container, the closure being adapted to be secured to the top of the container so as to close off the interior of the container, the closure having an interior and an exterior when so secured to the container, the closure also having an internal air-liquid mixing chamber, an orifice leading from the chamber to the exterior of the closure, and separate gas and liquid passage means extending from the interior into the chamber for conveying air and liquid into the chamber in which the improvement comprises: the closure being a dispensing closure having a cap and a spout rotatably mounted on the cap, the spout having a base and a discharge end, the chamber being located within the spout adjacent to the discharge end, the orifice being located within the spout so as to lead from the chamber through the discharge end, a part of each of the passage means being located within the spout and a part of each of the passage means being located so as to be aligned with one another when the spout is in an open position with respect to the cap, the spout being capable of being rotated from the open position to a closed position in which the parts of each of the passage means are spaced from one another and in which the base of the spout overlies the parts of the passage means in the cap, and sealing means for preventing leakage between the spout and the cap around the parts of the passage means which are located within the cap, the sealing means being located on the cap and engaging the spout in the open and closed positions of the spout.

BRIEF DESCRIPTION OF THE DRAWING

It is considered that the invention is best more fully explained by referring to the accompanying drawing in which.

Figure 1:
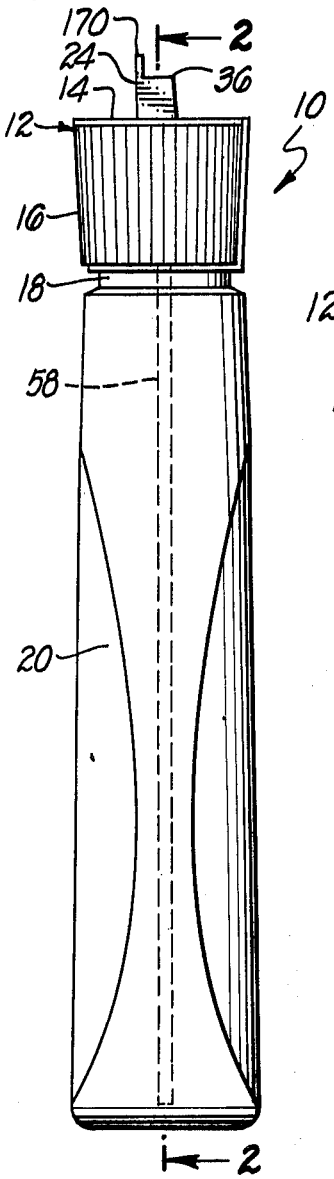
FIG. 1 is a side elevational view of a presently preferred embodiment or form of a spray dispensing closure in accordance with this invention installed upon a so called "squeeze bottle" container.

The particular spray dispensing closure illustrated in the drawing utilizes the operative concepts or principles of the invention set forth in the appended claims forming a part of this disclosure. These same concepts or principles may be embodied within other somewhat differently appearing and somewhat differently constructed closures through the use or exercise of routine engineering skill in the dispensing closure industry. For this reason the invention is not to be considered as being limited to the precise structures illustrated.

DETAILED DESCRIPTION

In the drawing there is shown a dispensing closure 10 of the present invention which is constructed so as to be capable of being utilized in dispensing a spray of liquid and air. All parts of this closure 10 hereinafter described are preferably constructed out of a polymeric, somewhat resilient material such as low or high density polyethylene, common molding grades of polypropylene or the like by conventional injection molding techniques so that the closure 10 may be easily and conveniently assembled in a conventional manner.

The closure 10 includes a cap 12 having a substantially horizontal top 14 and a dependent peripheral skirt 16 so as to enable the cap 12 to be assembled in a known manner on the neck 18 of a conventional so called "squeeze bottle" or container 20. This bottle 20 is capable of being squeezed by hand so as to reduce its internal volume. In the embodiment of the invention shown, mating threads 22 on the neck 18 within the skirt 16 are utilized in order to secure the cap 12 in place.

Figure 2:
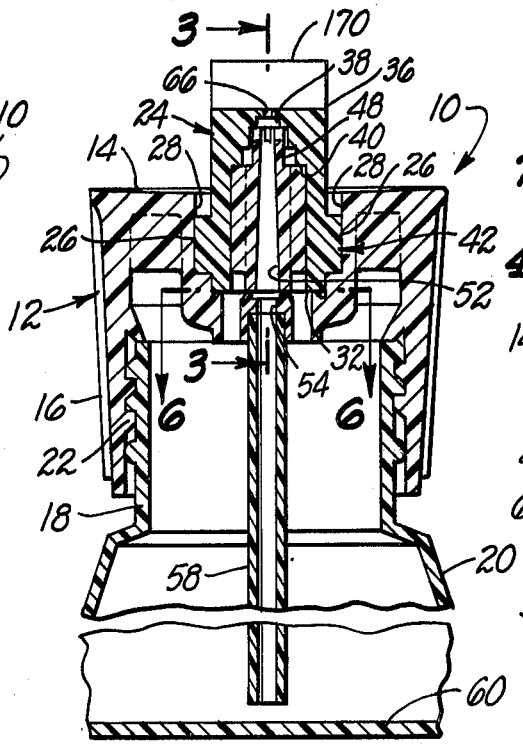
FIG. 2 is a partial cross-sectional view at an enlarged scale taken at line 2—2 of FIG. 1.
Figure 3:
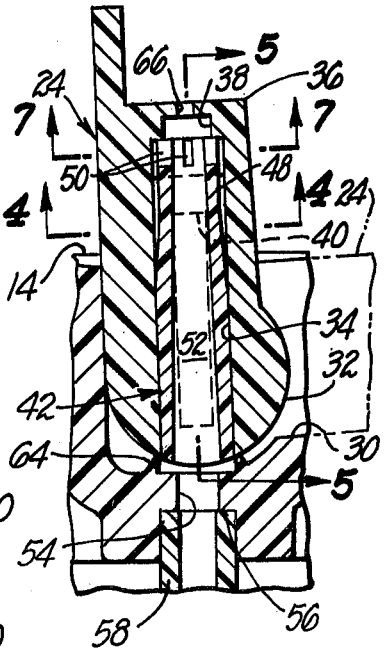
FIG. 3 is a partial cross-sectional view at an enlarged scale taken at line 3—3 of FIG. 2.

The closure 10 also includes a spout 24 which is rotatably mounted on the cap 12 through the use of aligned trunnions 26 on the spout 24 fitting within bearing openings 28 in the top 14 of the cap 12. This spout 24 is rotatably mounted in this manner so that it can be rotated between an open position as shown in FIGS. 1, 2 and 3 of the drawing in which it extends substantially vertically from the top 14 and a horizontal, closed position as indicated in phantom in FIG. 3 of the drawing in which it extends horizontally within a slot 30 in the top 14 of the cap 12.

The spout 24 is formed with a generally cylindrical base 32 so as to have an internal cavity 34 leading from this base 32 generally toward the discharge end 36 of the spout 24. This cavity 34 leads to a substantially cylindrical internal mixing chamber 38 within the spout 24 adjacent to this end 36. Preferably a shoulder 40 is located within the cavity 34 so as to serve as a stop element limiting the amount that a fitment 42 may be inserted into the cavity 34 from the base 32.

Figure 4:
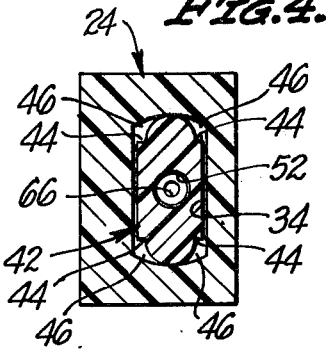
FIG. 4 is a cross-sectional view taken at line 4—4 of FIG. 3.
Figure 6:
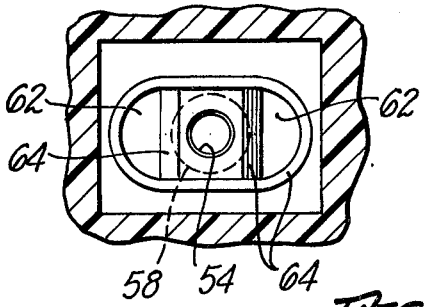
FIG. 6 is a partial cross-sectional view at an enlarged scale taken at line 6—6 of FIG. 2.
Figure 5:
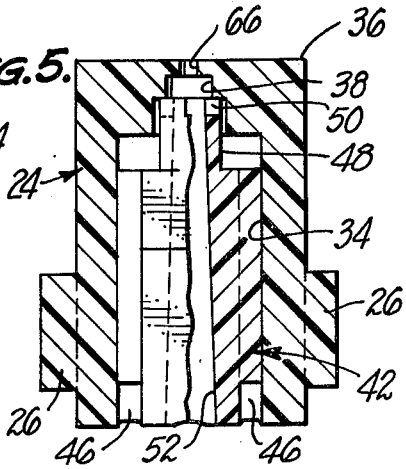
FIG. 5 is a partial cross-sectional view taken at line 5—5 of FIG. 2.
Figure 7:
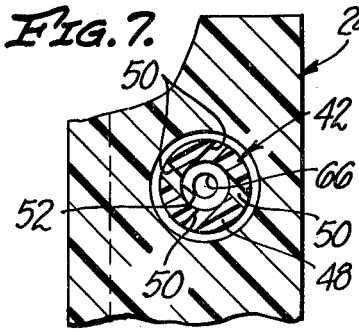
FIG. 7 is a cross-sectional view taken at line 7—7 of FIG. 3.

As is best seen from an examination of FIGS. 4 and 5 of the drawing, this fitment 42 fits closely within the cavity 34 so as to be held in place by friction. It is provided with four elongated grooves 44 extending along its length which are designed to provide elongated passages or spaces 46 within the spout 24 generally between the exterior of the fitment 42 and the interior of the cavity 34. This fitment 42 has an extension 48 generally adjacent to both the chamber 38 and the shoulder 40 which is intended to provide space to pass from the passages 46 into any of a plurality of slots 50 located in the extension 48 adjacent to the chamber 38.

The construction of these slots 50 is considered important to the effective operation of the closure 10. They extend tangentially to a generally cylindrical hole or passage 52 within the fitment 42 immediately adjacent to the chamber 38. It will be noted that the extremities (not separately numbered) of these slots 50 closest adjacent to the hole 52 are exposed to the interior of the chamber 38. This results from the chamber 38 being of slightly larger diameter than the hole 52. With the structure shown both the hole 52 and the chamber 38 are axially aligned.

When the spout 24 is open the hole 52 and the fitment 42 are also aligned with a hole or opening 54 in the cap 12 leading through this cap 12 into its interior (not separately numbered). A shoulder 56 may be located within this hole 52 for the purpose of limiting the insertion of a tube 58 within this hole 54. The tube 58 is normally held by friction within the hole 54 so as to extend downwardly from the cap 12 to adjacent to the bottom 60 of the container 20. Other holes or passages 62 are provided in the cap 12 adjacent to the hole or opening 54 for the pressure of placing the interior (not separately numbered) of the neck 18 in communication with the various passages 46 described in the preceding.

A series of flexible, inverted, V-like upstanding sealing members 64 are located on the cap 12 around the hole 54 and around the openings 62. These sealing members 64 engage the base 32 of the spout 24 at all times so as to seal against leakage from between the spout 24 and the cap 12. They also seal off the hole 52 and the opening 54 from the adjacent passages 62 and 46.

If desired the tube 58, the hole 52 and the hole 54 may be regarded as a complete liquid passage (not separately numbered) in the closure 10 and the passages 46 in their associated passages 62 may each be regarded as a separate complete air passage (not separately numbered). At least one such air passage is required in the closure 10. It is considered that it is preferable to use several such air passages. It will be realized that parts of such complete liquid and air passages are located both within the cap 12 and within the spout 24.

When the closure 10 is to be utilized in dispensing a liquid the spout 24 is moved to an open position as shown in FIGS. 1 to 3 as the container 20 is held in an upright position when it is less than completely filled with a liquid. The container 20 is then compressed so as to reduce its internal volume. This will have the effect of forcing the liquid (not shown) within the container 20 to move upwardly through the tube 48 into and through the holes 54 and 52. Concurrently this will have the effect of forcing air in the container 20 above the liquid through the passages 62 and 46. Such air will then move through the slots 50 so as to contact the liquid in the hole 52 adjacent to the chamber 38 in order to cause such liquid to swirl as it moves upwardly toward the chamber 38.

Concurrently some of this gas will escape directly into the chamber 38 so as to tend to further dilute the upwardly moving liquid and gas as this liquid continues to swirl as it enters the chamber 38. As a result of this there is formed within the chamber 38 a mixture of compressed air and liquid in which the liquid tends to be very finely divided and/or dispersed in compressed air. It is considered obvious that there is a great deal of turbulence within the chamber 38 and in the hole 52 generally adjacent to the slots 50. The edges (not separately numbered) of the slots 50 which are exposed to the interior of the chamber 38 are considered to contribute to the break up of the liquid into droplets by exercising what may be referred to as a shearing action on the compressed, swirling gas-liquid mixture present.

Such a mixture is removed from the closure 10 through a discharge orifice 66 located so as to be axially aligned with the chamber 38 and the hole 52 in the end 36. This orifice 66 may, but need not be, especially shaped, so as to create a specialized spray pattern from the liquid-air mixture emitted through it. When the orifice 66 is centrally located as indicated in FIGS. 1 to 3 of the drawing the mixture emitted from it is essentially the mixture that is pushed toward the center of the chamber 38 as there is a continued air-liquid contact tending to cause a break up of the liquid around the exterior of the chamber 38.

Figure 8:
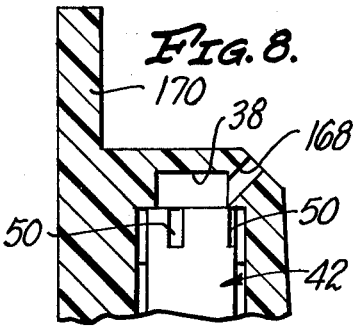
FIG. 8 is a partial cross-sectional view corresponding to a part of FIG. 3 showing a modified form of a spray dispensing closure of the invention.

In FIG. 8 of the drawing there is shown a modified closure 100 which is substantially identical to the closure 10 except for the orifice 168 utilized in this closure 100. For this reason the various other parts of the closure 100 except for the orifice 168 are not separately described herein and are designated in the drawing and where necessary for explanatory purposes in the remainder of this specification by the numerals previously utilized preceded by the numeral "1".

The orifice 168 is located so as to extend radially from the chamber 138 at an angle to the axis of this chamber so as to be pointed generally away from the discharge end 136 at an angle to the spout 124. This orifice 168 is considered to be very desirable in creating an air-liquid spray which does not impinge upon a part 170 of the spout 124 at an angle which is considered to facilitate the application of such a spray to certain parts of the body when the closure 100 and the container 120 are used for such a purpose. With the orifice 166 the radial discharge of the liquid-air mixture which tends to be swirling about within the chamber 138 is considered to effectively create what may be loosely referred to as a "composite" flow pattern within the chamber 138 which promotes an effective spraying action.

I claim:

1. A closure for use in dispensing a spray of liquid and air from a container, said closure being adapted to be secured to the top of said container so as to close off the interior of said container, said closure having an interior and an exterior, an internal air-liquid mixing chamber, an orifice leading from said chamber to said exterior, and separate gas and liquid passage means extending from said interior into said chamber for conveying air and liquid into said chamber, in which the improvement comprises:

said closure being a dispensing closure having a cap and a spout rotatably mounted on said cap, said spout having a base and a discharge end, a portion of said cap being located adjacent to said base, said spout including an internal elongated cavity extending from said base toward said discharge end, said mixing chamber being located at an extremity of said cavity adjacent to said discharge end, said orifice being located in said discharge end, a fitment located within said cavity, said fitment fitting closely within said cavity so as to be secured in place by engagement with the interior of said cavity, said gas passage means including a plurality of elongated groove-like spaces between the exterior of said fitment and the interior of said cavity and holes extending through said portion of said cap, said liquid passage means including an elongated hole extending within the center of said fitment from said base of said spout to said chamber and a hole leading through said portion of said cap, said spout being capable of being rotated between an open position in which said holes of said gas passage means are aligned with said spaces and in which said holes of said liquid passage means are aligned with one another and a closed position in which said holes of both of said passage means in said cap are covered by said base of said spout, sealing means for preventing leakage between said spout and said cap located on said cap and engaging said spout in both said opened and said closed positions so as to form a seal therewith, said sealing means serving to form a seal between individual of said passage means when said spout is in said open position, said mixing passage means comprising a groove leading from the extremity of each of said groove-like spaces to said elongated hole adjacent to said mixing chamber, said orifice being smaller than the interior of said mixing chamber, a liquid tube attached to said cap so as to extend therefrom, said tube being in communication with said part of said liquid passage means within said cap.

2. A closure as claimed in claim 1 wherein:

said elongated hole within the center of said fitment is a cylindrical hole, and said grooves of said mixing passage means are located transverse to the length of said hole and lead tangentially into said hole at the end of said hole in communication with said mixing chamber.

3. A closure as claimed in claim 1 wherein:

said grooves of said mixing passage means are located in said fitment.

4. A closure as claimed in claim 1 wherein:

said chamber is a generally cylindrical chamber located between said fitment and said discharge end, said elongated hole within the center of said fitment is aligned with the axis of said cylindrical chamber, said grooves of said mixing passage means are located within said fitment and are partially exposed to the interior of said mixing chamber.

5. A closure as claimed in claim 1 wherein:

said elongated hole within the center of said fitment is a cylindrical hole, said grooves of said mixing passage means are located transverse to the length of said hole and lead tangentially into said hole at the end of said hole in communication with said mixing chamber, said grooves of said mixing passage means are located in said fitment, said chamber is a generally cylindrical chamber located between said fitment and said discharge end, said elongated hole within the center of said fitment is aligned with the axis of said cylindrical chamber, said grooves of said mixing passage means are located within said fitment and are partially exposed to the interior of said mixing chamber.

* * * * *